US005953795A

United States Patent [19]

Bauer

[11] Patent Number: 5,953,795

[45] Date of Patent: Sep. 21, 1999

[54] MAGNETIC SNAP LOCK

[76] Inventor: Irving Bauer, 1624 Webster Ave., Bronx, N.Y. 10457

[21] Appl. No.: 08/898,244

[22] Filed: Jul. 22, 1997

[51] Int. Cl.[6] ..... A44B 21/00

[52] U.S. Cl. ..... 24/303

[58] Field of Search ..... 24/303, 66.1; 292/251.5; 248/206.5; 335/285, 303, 304

[56] References Cited

U.S. PATENT DOCUMENTS

| | | | |
|---|---|---|---|
| 4,455,719 | 6/1984 | Morita | 24/303 |
| 4,779,314 | 10/1988 | Aoki | 24/303 |
| 5,208,951 | 5/1993 | Aoki | 24/303 |
| 5,572,773 | 11/1996 | Bauer . | |
| 5,611,120 | 3/1997 | Riceman et al. | 24/303 |
| 5,675,874 | 10/1997 | Chen | 24/303 |

FOREIGN PATENT DOCUMENTS

| | | | |
|---|---|---|---|
| 58-106810 | 6/1983 | Japan | 335/285 |

*Primary Examiner*—James R. Brittain

*Attorney, Agent, or Firm*—Oblon, Spivak, McClelland, Maier & Neustadt, P.C.

[57] ABSTRACT

A magnetic snap lock includes male and female members which can cooperate with each other to achieve a locking condition. The female member of the present invention includes a base plate or base plate assembly. A magnetic member is mounted on the base plate or base plate assembly and causes an attraction of the male member towards the female member to provide for the locking condition. A cover member which can be made of a non-ferromagnetic material, is used to substantially cover the top and side portions of the magnetic member.

25 Claims, 3 Drawing Sheets

FIG. 6
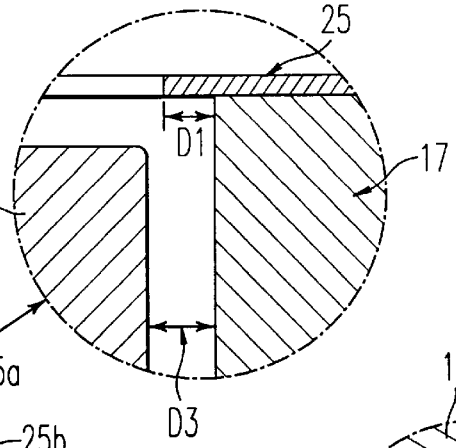
FIG. 1
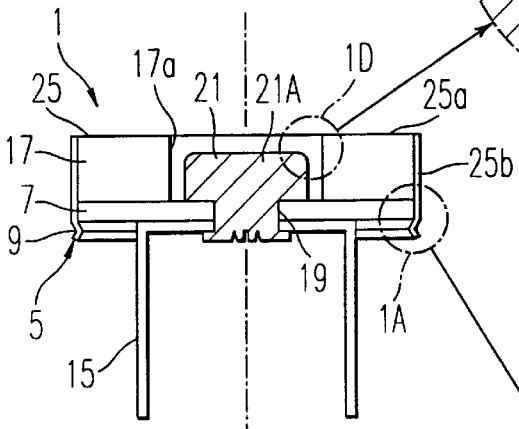
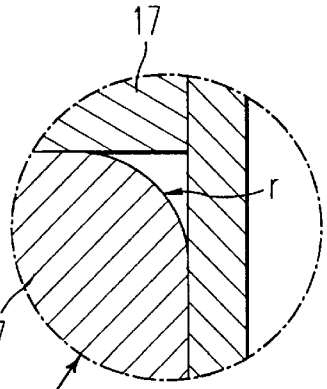
FIG. 5
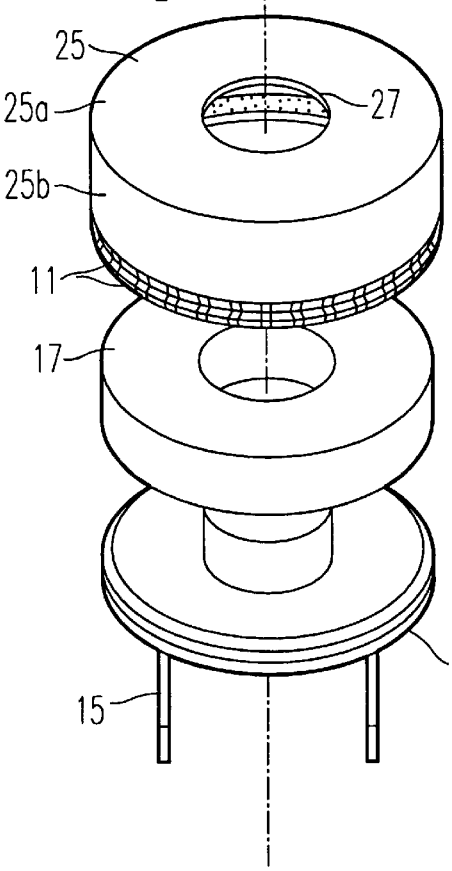
FIG. 2
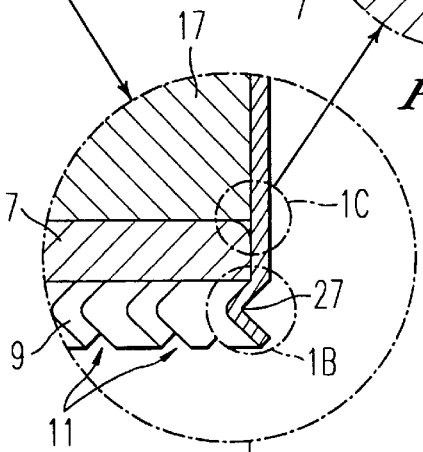
FIG. 3
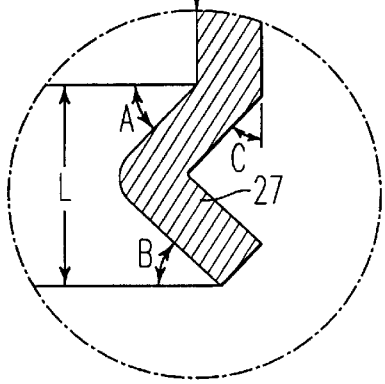
FIG. 4

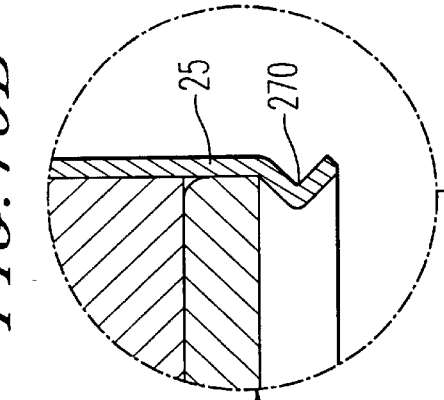
FIG. 10B
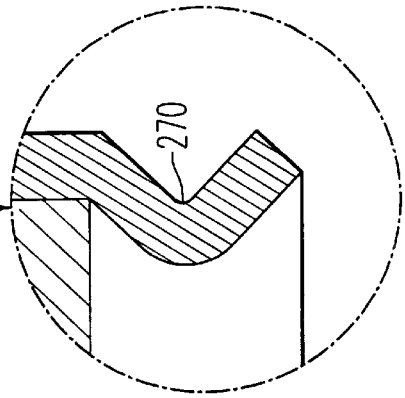
FIG. 10C
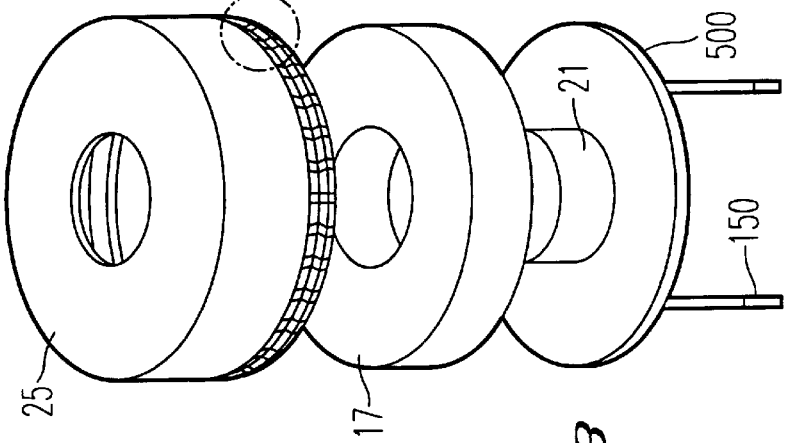
FIG. 10A
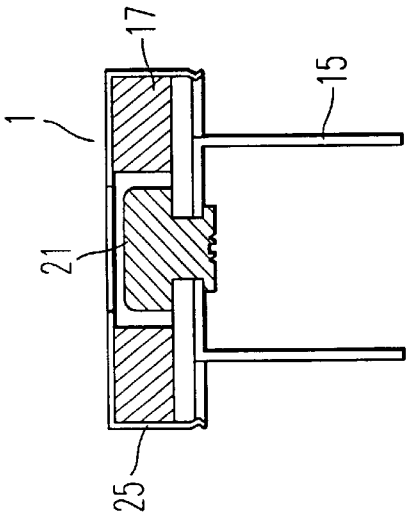
FIG. 9
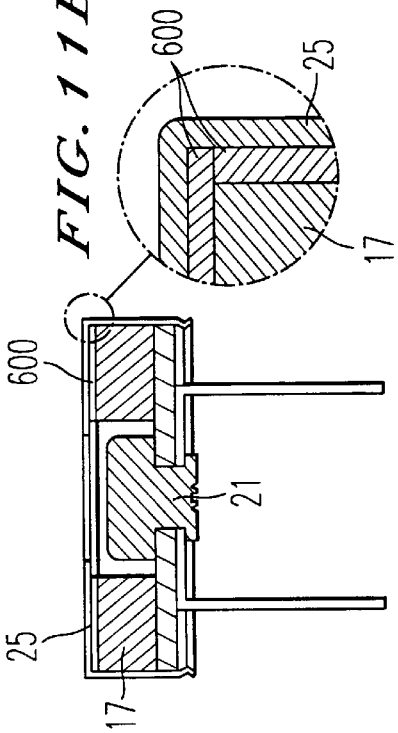
FIG. 11B
FIG. 11A

MAGNETIC SNAP LOCK

BACKGROUND OF THE INVENTION

1. Field of the Invention

The present invention relates to a magnetic snap lock which utilizes a permanent magnet. The magnetic snap lock can be used on handbags, pocketbooks, etc. and comprises a female part having a permanent magnet and a male part which is attracted to the female part for magnetically attracting and locking the two parts together.

2. Discussion of the Background

Magnetic locks having male and female members and using the attraction of a permanent magnet are known. Conventional devices rely upon the strength of the magnetic attraction for achieving the locking of the male and female parts together. However, some of the conventional magnetic locking devices have drawbacks in that they are complicated in structure and in some cases do not provide for a sufficient magnetic attraction and strength to assure an effective locking of the parts to be locked. Additionally, the structure of some conventional magnetic locks makes it difficult to properly align male and female members together, and makes it difficult to assemble the lock.

SUMMARY OF THE INVENTION

An object of the present invention is to provide for a magnetic snap lock which overcomes the above-noted drawbacks of conventional snap locks.

In the magnetic snap lock of the present invention, the female member includes a magnetic member and a base plate assembly. In one embodiment, a rivet can extend through an aperture in the base plate assembly and be positioned within the hole of the magnetic member. A cover member is press fitted and/or tightly fitted over the magnetic member and the base plate assembly so as to maintain proper positioning of the magnet. In a further embodiment, the cover member can be fitted over the magnetic member with a peripheral washer being fitted between the cover member and the outer wall of the magnetic member so as to provide a tight or snug fit. The base plate assembly can include a crimping arrangement such that indented portions of the cover member can be snap fitted into corresponding notches of the base plate assembly. Also, the cover member can be made of a non-ferromagnetic material.

This structure provides for a female member of the magnetic snap lock which is easy to assemble, exhibits structural rigidity and keeps the magnet in position.

The present invention therefore provides for a magnetic snap lock which comprises a male member and a female member which can cooperate with each other to define a locking position. The female member includes a base plate assembly which has an aperture, and a first rivet which includes a first portion that extends through the aperture of the base plate assembly.

The female member further includes a magnetic member which is mounted on the base plate assembly, with the magnetic member having a first hole which is concentric with the aperture of the base plate assembly. The magnetic member is mounted on the base plate assembly so as to surround a second portion of the first rivet. The female member also includes a cover member which substantially covers the magnetic member. The cover member has a second hole which is concentric with the first hole of the magnetic member.

The present invention also provides for a magnetic snap lock which comprises a male member and a female member which can cooperate with each other to define a locking position. The female member can include first and second plate means, with each of the first and second plate means respectively comprising first and second concentric apertures. The female member further comprises fastening means which fastens the first and second plate means together, with the fastening means extending through the concentric first and second apertures of the first and second plate means.

The female member further includes attraction means mounted on one of the first and second plate means for attracting the male member to the female member to achieve the locking position, and means for substantially covering the attraction means.

The present invention also provides for a magnetic snap lock which comprises a male member and a female member which can cooperate with each other to define a locking position, with the female member including a base plate and a magnetic member which is mounted on the base plate. The female member further includes a cover member which substantially covers the magnetic member.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 is a side view of the female member of the magnetic snap lock of the present invention;

FIG. 2 is an exploded view of the female member of the magnetic snap lock as illustrated in FIG. 1;

FIG. 3 is a view of detail 1A of FIG. 1;

FIG. 4 is a view of detail 1B of FIG. 3;

FIG. 5 is a view of detail 1C of FIG. 3;

FIG. 6 is a view of detail 1D of FIG. 1; and

FIG. 9 is a sectional side view of the female member;

FIG. 10A is an exploded view of the female member of the present invention;

FIG. 10B is a detailed view of the circled portion of FIG. 10A;

FIG. 10C is a detailed view of the view of FIG. 10B;

FIG. 11A is a side view of a further feature of the female member of the present invention; and FIG. 11B is a detailed view of the circled portion in FIG. 11A.

DESCRIPTION OF THE PREFERRED EMBODIMENTS

Figure 7:
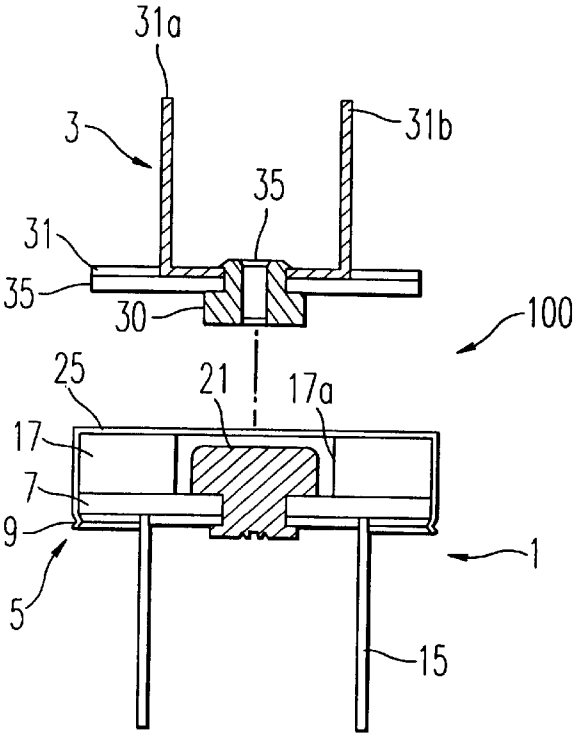
FIG. 7 is a view of the female member of FIG. 1 and a male member which make up the magnetic snap lock, in which the male and female members are spaced from each other.

Referring now to the drawings, wherein like reference numerals designate identical or corresponding parts throughout the several views, and more particularly to FIGS. 1 and 7, FIG. 1 shows a side view of a female member 1 of the magnetic snap lock of the present invention. FIG. 7 shows the female member 1 and a male member 3 of a magnetic snap lock assembly 100.

Referring to FIG. 1, female member 1 includes a base plate assembly 5 which can include a first portion or annular plate 7 having a substantially smooth outer circumference, and a second portion or annular plate 9, having an outer circumference with notches 11 as illustrated in FIGS. 2 and 3. The second portion 9 of the base plate assembly 5 can include prongs 15 or other equivalent elements which permit the fitting of the female member 1 to an article.

As illustrated in FIGS. 1–3 and 7, mounted on the base plate assembly 5, is a magnetic member 17 which can be, for example, glued onto the base plate assembly 5.

The base plate assembly 5 can comprise a hole 19 which can be made up of concentric holes of the first portion or plate 7 and the second portion or plate 9 of the base plate assembly 5. Passing through the hole 19 defined by the base plate assembly 5 is a rivet 21 which can be utilized to fasten the portions 7 and 9 of the base plate assembly 5 together. The rivet 21 can be a solid rivet and includes a portion 21*a* which extends within a hole 17*a* defined by the magnetic member 17.

As further illustrated in the figures, a cover 25 with no lip which can be made of a non-ferromagnetic material is press and/or tightly fitted over the magnetic member 17 and the base plate assembly 5. The cover 25 can be, for example, a plastic cover. The cover member 25 includes a top portion 25*a* which covers the top of the magnet 17 and includes a hole 27 which is concentric with the hole 17*a* of the magnet 17. The cover member 25 also includes a side portion 25*b* which covers the sides of the magnet 17 and is extended so as to be press and/or tightly fitted over the first and second portions 7, 9 of the base plate assembly 5. As illustrated in FIGS. 1–3 and 7, the side portion 25*b* of the cover 25 includes a lower part which defines radially inwardly extending indentations which can be fitted into cooperating notches 11 on the portion 9 of the base plate assembly 5 so as to achieve a snap fit of the cover member 25 over the magnetic member 17 and the base plate assembly 5. It is recognized that, depending on design considerations, the base plate assembly 5 and/or the cover member 25 can include the notches 11. The indentations 27 can be manufactured such that the angles A, B and C illustrated in FIG. 4 are around 45 degrees. However, this is only one example, and it is recognized that the size of the angles A, B and C can be based on design considerations. It is further recognized that the distance L (FIG. 4) of the indentations 27 is based on design considerations.

As illustrated in FIG. 2 as well as FIG. 5, the top portion 7 of the base plate assembly 5 can include a slight radius of curvature r, which can be, for example, 0.50, and the bottom plate 9 as illustrated in FIG. 3 includes the notches 11. This permits a snap or tight fitting feature as discussed above.

As illustrated in FIG. 6, the cover member 25 can extend radially inwardly slightly beyond the edge of the magnetic member by a distance D1 and an air gap D3 can exist between the portion 21*a* of the rivet 21 which extends within the hole 17*a* of the magnet 17 and the magnet. Thus, the hole 27 of the cover member 25 with no lip is smaller than the hole 17*a* of the magnet 17. This increases the holding capability of the magnet 17 and prevents the rivet 21 from shorting out against the inner wall of the hole in the magnet.

As described above, the cover member 25 is tightly fitted onto the magnet 17 and the base plate assembly 5. This tight fit maintains the magnet 17 in position and can provide for a minimal air gap between the side 25*b* of the cover 25 and the outside wall of the magnet 17. Of course, it is recognized that a slight gap can be maintained between the side 25*b* of the cover 25 and the magnet 17 as long as the snapping features between the indented portions 27 of the cover 25 and the notches 11 of the lower portion 9 of the base plate assembly 5 is maintained.

FIG. 7 shows an example of a male member 3 which can be used in cooperation with the female member 1 of the present invention. As illustrated in FIG. 7, the male member 3 can include a rivet 30 which can be utilized to hold plates 31 and 35 together.

The rivet 30 of the male member 3 can be a rivet with a hole 35 which extends partially through, substantially through or all the way through the rivet 30. Of course, the rivet 30 can be a solid rivet which has no hole. Thus, the type of rivet and male member utilized within the context of the present invention can be based on design considerations. The male member 3 can further include prongs 31*a* and 31*b* which extend from the plate member 31 so as to permit an attachment to an article.

Therefore, in use, the male member 3 or female member 1 can be attached to one portion of, for example, a handbag, while the other of the male member 3 or female member 1 can be attached on a second portion such as a flap of the handbag. Accordingly, the female member 1 magnetically attracts the male member 3 so as to permit the plate 35 of the male member 3 to contact the cover member 25. The magnetic attraction of the male member 3 towards the female member 1 can further position the rivet 30 of the male member 3 within the opening 17*a* defined by the magnetic member 17 and adjacent to the rivet 21. Therefore, in the illustration of FIG. 7, in a locking position, the plate 35 will be abutted against the cover member 25, with the rivet 30 extending within the hole 17*a* defined by the magnetic member 17.

Figure 8C:
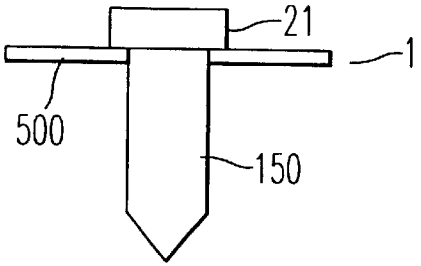
FIGS. 8A, 8B and 8C are respectively isometric, sectional and side views of a further embodiment of the female member of the present invention.
Figure 8B:
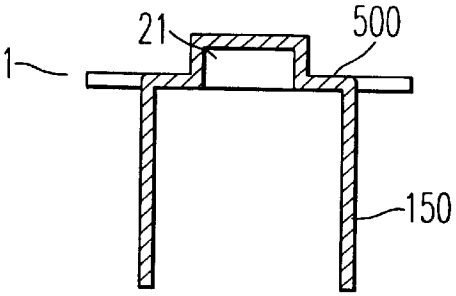
Figure 8A:
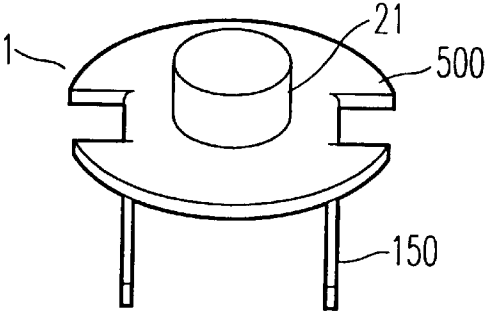

As a further embodiment, the base plate assembly can be composed of a single base plate 500 with prongs 150 bent down from the base plate 500 as illustrated in FIGS. 8A–8C. With the arrangement of FIGS. 8A–8C, since only a single base plate 500 is utilized there is no need for a rivet on the female member, and the rivet would only be on the male member 3. Also, with this arrangement, the rivet on the male member 3 would be longer so as to extend within the opening in the magnetic member of the female member.

As a further embodiment of the present invention, the cover member 25 does not have to include notches and could snap fit over a magnetic member with no notches on the plate. The cover member 25 could therefore be glued onto the magnet or held in place by a snug fit as illustrated in FIG. 9 As a further embodiment, instead of notches on the cover member 25, the cover member 25 could have ridges 270 around a periphery as illustrated in FIGS. 10A–10C. The ridges 270 can extend all the way around the cover member 25 or can be located on a designated portion of the cover member. The ridges could also extend at least partially up from the base plate assembly.

In a further feature of the present invention, a soft washer 600 can be positioned between the magnetic member 17 and the cover member 25 for holding the magnetic member in place as illustrated in Figures 11A–11B. The soft washer 600 can be made of a non-ferromagnetic material. As a further option, a thin layer of non-ferromagnetic material can be placed between an outer wall of the magnetic member and an inner wall of the cover so as provide for a snug fit. In the embodiment in which a soft washer or a thin layer of non-ferromagnetic material is utilized, a snug fit is provided and there is no need for precise sizing tolerances between the magnetic member and the cover member.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A magnetic snap lock comprising:

a male member and a female member which are cooperable with each other to define a locking position;

said female member including:

a base plate assembly having an aperture;

a first rivet which includes a first portion that extends through the aperture of said base plate assembly;

a magnetic member which is mounted on said base plate assembly, said magnetic member having a first hole which is concentric with said aperture of said base plate assembly, said magnetic member being mounted on said base plate assembly so as to surround a second portion of said rivet; and a cover member which substantially covers said magnetic member, said cover member having a second hole which is concentric with said first hole of said magnetic member wherein said base plate comprises a first portion having a substantially smooth outer circumference and a second portion having an outer circumference which comprises a plurality of notches and wherein said second portion comprises attachment prongs.

2. A magnetic snap lock according to claim 1, wherein:

said male member comprises at least one plate and a second rivet which extends through said at least one plate; and said magnetic member of said female member magnetically attracts and magnetically fastens said male member to said female member to achieve said locking position by positioning a portion of said second rivet within said respective first and second holes of the magnetic member and said cover member, and positioning said second rivet adjacent to the second portion of said first rivet, causing said at least one plate of the male member to be magnetically fastened to the magnetic member with the cover therebetween.

3. A magnetic snap lock according to claim 1, wherein said cover member comprises a lower part which includes a radially inwardly indented portion.

4. A magnetic snap lock according to claim 3, wherein said cover member is fitted over said magnetic member and said base plate assembly, such that the radially inwardly indented portion of the cover member snap fits into the notches of the second portion of the base plate assembly.

5. A magnetic snap lock according to claim 1, wherein said cover member is made of a non-ferromagnetic material.

6. A magnetic snap lock according to claim 1, wherein the second hole of said cover member is smaller than the first hole of the magnetic member.

7. A magnetic snap lock according to claim 1, further comprising adhering means for adhering the cover member to the magnetic member.

8. A magnetic snap lock according to claim 7, wherein said adhering means comprises glue.

9. A magnetic snap lock according to claim 1, wherein said cover member comprises ridges around a periphery thereof so as to provide for a tight fit of the cover member on the magnetic member.

10. A magnetic snap lock according to claim 9, wherein the ridges are provided on a portion of the cover member.

11. A magnetic snap lock according to claim 10, wherein the ridges extend at least partially up from a lower portion of the cover member.

12. A magnetic snap lock according to claim 1, wherein a soft washer is positioned between an outer surface of the magnetic member and an inner surface of the cover member.

13. A magnetic snap lock according to claim 12, wherein said soft washer is made of non-ferromagnetic material.

14. A magnetic snap lock according to claim 1, wherein a thin layer of non-ferromagnetic material is placed between an outer surface of the magnetic member and an inner surface of the cover member.

15. A magnetic snap lock according to claim 1, wherein one of said male or female members is attached to one portion of a handbag, and the other of said male or female members is attached to a second portion of a handbag.

16. A magnetic snap lock comprising:

a male member and a female member which are cooperable with each other to define a locking position;

said female member including:

first and second plate means, said first and second plate means respectively comprising first and second concentric apertures;

fastening means which fastens said first and second plate means together, said fastening means extending through the concentric first and second apertures of said first and said plate means;

attraction means mounted on one of said first and second plate means for attracting said male member to said female member to achieve the locking position; and means for substantially covering said attraction means wherein said first plate comprises a cover which includes a v-shaped ridge extending completely around a peripheral portion thereof for fitting of the cover onto the attraction means and wherein said male member has attachment prongs which extend therefrom, said ridge extending inwardly beneath said first plate to hold said first plate in contact with said attraction means.

17. A magnetic snap lock comprising:

a male member and a female member which are cooperable with each other to define a locking position;

said female member including:

a base plate;

a magnetic member which is mounted on said base plate; and a cover member which substantially covers said magnetic member wherein said cover member comprises a v-shaped ridge extending completely around a peripheral portion thereof for fitting of the cover onto the magnetic member and wherein said male member has attachment prongs which extend therefrom, said ridge extending inwardly beneath said base plate to hold said base plate in contact with said magnetic member.

18. A magnetic snap lock according to claim 17, wherein said magnetic member has a first hole which is larger than a second hole on the cover member.

19. A magnetic snap lock according to claim 17, further comprising adhering means for adhering the cover member to the magnetic member.

20. A magnetic snap lock according to claim 19, wherein said adhering means comprises glue.

21. A magnetic snap lock according to claim 19, wherein the ridge is provided on a portion of the cover member.

22. A magnetic snap lock according to claim 17, wherein the ridge extends at least partially up from a lower portion of the cover member.

23. A magnetic snap lock according to claim 17, wherein a soft washer is positioned between an outer surface of the magnetic member and an inner surface of the cover member.

24. A magnetic snap lock according to claim 23, wherein said soft washer is made of non-ferromagnetic material.

25. A magnetic snap lock according to claim 17, wherein a thin layer of non-ferromagnetic material is placed between an outer surface of the magnetic member and an inner surface of the cover member.

* * * * *